US010056241B2

(12) United States Patent
Wehrs

(10) Patent No.: US 10,056,241 B2
(45) Date of Patent: Aug. 21, 2018

(54) ADDITION OF REACTIVE SPECIES TO ICP SOURCE IN A MASS SPECTROMETER

(71) Applicant: Thermo Fisher Scientific (Bremen) GmbH, Bremen (DE)

(72) Inventor: Henning Wehrs, Bremen (DE)

(73) Assignee: Thermo Fisher Scientific (Bremen) GmbH, Bremen (DE)

( * ) Notice: Subject to any disclaimer, the term of this patent is extended or adjusted under 35 U.S.C. 154(b) by 0 days.

(21) Appl. No.: 15/338,727

(22) Filed: Oct. 31, 2016

(65) Prior Publication Data

US 2017/0140914 A1 May 18, 2017

(30) Foreign Application Priority Data

Nov. 17, 2015 (GB) ..... 1520208.8

(51) Int. Cl.
*H01J 49/10* (2006.01)
*H01J 49/00* (2006.01)
(Continued)

(52) U.S. Cl.
CPC ..... *H01J 49/105* (2013.01); *H01J 49/0027* (2013.01); *H01J 49/0077* (2013.01); *H01J 49/14* (2013.01); *H01J 49/421* (2013.01)

(58) Field of Classification Search
CPC ..... H01J 49/0027; H01J 49/0031; H01J 49/0077; H01J 49/105; H01J 49/14; H01J 49/421
See application file for complete search history.

(56) References Cited

U.S. PATENT DOCUMENTS 5,049,739 A 9/1991 Okamoto
5,526,110 A * 6/1996 Braymen ..... G01N 21/73 250/252.1
(Continued)

FOREIGN PATENT DOCUMENTS

CN 103329242 A 9/2013
CN 203339108 U 12/2013
(Continued)

OTHER PUBLICATIONS

Weyer and Schweiters, "High Precision Fe Isotope Measurements With High Mass Resolution MC-ICPMS", International Journal of Mass Spectrometry 226 (2003) 355-368.*
(Continued)

*Primary Examiner* — David E Smith
(74) *Attorney, Agent, or Firm* — A. J. Gokcek

(57) ABSTRACT

Disclosed is a method of inductively coupled plasma mass spectrometry (ICP-MS), comprising steps of introducing at least one sample comprising at least one sample species, and at least one reactive species, into an inductively coupled plasma source, such that at least one molecular adduct ion of the at least one reactive species and the at least one sample species is formed; transferring the at least one molecular adduct ion into a collision cell that is arranged between the inductively coupled plasma source and at least one mass analyzer, transferring the at least one molecular adduct ion, or a product thereof, into the at least one mass analyzer, and analyzing the mass of the at least one molecular adduct ion, or the product thereof, in the at least one mass analyzer. Also disclosed is a mass spectrometer that is adapted to perform the method.

27 Claims, 3 Drawing Sheets

(51) Int. Cl.
*H01J 49/14* (2006.01)
*H01J 49/42* (2006.01)

(56) References Cited

U.S. PATENT DOCUMENTS

| | | | | |
|---|---|---|---|---|
| 6,833,544 | B1 * | 12/2004 | Campbell | H01J 49/4225 250/281 |
| 8,610,053 | B2 * | 12/2013 | Yamada | H01J 49/0495 250/281 |
| 8,822,948 | B1 | 9/2014 | Hartwell | |
| 2010/0108879 | A1 * | 5/2010 | Bateman | G01N 27/622 250/283 |
| 2011/0210242 | A1 * | 9/2011 | Bateman | H01J 27/02 250/282 |
| 2012/0091331 | A1 * | 4/2012 | Badiei | H01J 49/005 250/282 |
| 2012/0122077 | A1 | 5/2012 | Hughes et al. | |
| 2013/0260478 | A1 * | 10/2013 | Ewing | G01N 33/0057 436/501 |
| 2013/0292565 | A1 * | 11/2013 | Kalinitchenko | H01J 49/0013 250/288 |
| 2015/0090876 | A1 | 4/2015 | Hughes et al. | |

FOREIGN PATENT DOCUMENTS

| | | | |
|---|---|---|---|
| EP | 0813228 | B1 | 7/2002 |
| WO | WO9725737 | A1 | 7/1997 |
| WO | WO2014076556 | A1 | 5/2014 |

OTHER PUBLICATIONS

Douglas, "Some Current Perspectives on ICP-MS," Canadian Journal Spectroscopy, 34(2), 38-49, 1989.
Eiden et al., "Selective Removal of Plasma Matrix Ions in Plasma Source Mass Spectrometry," J. Anal. At. Spec., 11, 317-322, 1996.
GB application No. 1514479.3, filed Aug. 14, 2015, to Schwieters (specification, claims, abstract, figures only).
Hattendorf et al., "Suppression of in-cell generated interferences in a reaction cell ICP-MS by bandpass tuning and kinetic energy discrimination," J. Anal. At. Spectrom., 19, 600-606, 2004.
Koppenaal et al., "Collision and reaction cells in atomic mass spectrometry: development, status, and applications," J. Anal. At. Spectrom., 19, 561-570, 2004.
Tanner et al., "Reaction cells and collision cells for ICP-MS: a tutorial review," Spectrochimica Acta Part B, 57, 1361-1452, 2002.
Weyer et al., "High precision Fe isotope measurements with high mass resolution MC-ICPMS," Int. J. Mass Spec., 226, 355-368, 2003.

* cited by examiner

ADDITION OF REACTIVE SPECIES TO ICP SOURCE IN A MASS SPECTROMETER

CROSS-REFERENCE TO RELATED APPLICATION

This application claims the priority benefit under 35 U.S.C. § 119 to British Patent Application No. 1520208.8, filed on Nov. 17, 2015, the disclosure of which is incorporated herein by reference.

FIELD OF THE INVENTION

The invention relates to a mass spectrometer, in particular an inductively coupled plasma mass spectrometer (ICP-MS). The invention furthermore relates to methods of mass spectrometry.

BACKGROUND OF THE INVENTION

Mass spectrometry is an analytical method for qualitative and quantitative determination of molecular species present in samples, based on the mass to charge ratio and abundance of gaseous ions.

In inductively coupled plasma mass spectrometry (ICP-MS), atomic species can be detected with high sensitivity and precision, at concentrations as low as 1 in $10^{15}$ with respect to a non-interfering background. In ICP-MS, the sample to be analyzed is ionized with an inductively coupled plasma and subsequently separated and quantified in a mass analyzer.

Precise and accurate isotope ratio measurements very often provide the only way to gain deeper insight into scientific questions which cannot be answered by any other analytical technique. Multicollector ICP-MS is an established method for high precision and accurate isotope ratio analysis. Applications of ICP-MS are in the field of geochronology, geochemistry, cosmochemistry, biogeochemistry, environmental sciences as well as in life sciences. However, elemental and molecular interferences in the mass spectrometer can limit the attainable precision and accuracy of the analysis.

These interferences can be present in the sample material itself or are generated by sample preparation from a contamination source, such as chemicals used, sample containers, or by fractionation during sample purification. Contaminating species can also be generated in the ion source or in the mass spectrometer.

In order to achieve high precision and accurate isotope ratio measurements, extended physical and chemical sample preparation is applied to get clean samples free from possible interferences and contamination that can interfere in the mass spectrum. Typical concentrations of analyte in sample material used in isotope ratio ICP-MS are in the range of parts per billion. The analyte of interest may also be concentrated in small inclusions or crystals within a heterogeneous sample material, for example in rock samples.

Extended quality control steps are integrated into the sample preparation to ensure that the sample preparation itself does not lead to changes in the isotope ratio of the sample material. Every sample preparation step comes along with the possibility of adding contamination to the samples and/or causing isotopic fractionation of the analyte to be extracted from the original sample material, which could be for instance a rock, a crystal, soil, a dust particle, a liquid and/or organic matter. Even if all these steps are taken with great care there still is the chance of contamination and incomplete separation and interferences in the mass spectrum.

Ideally one would like to completely avoid the chemical sample preparation step. Moreover a chemical sample preparation is impossible if a laser is used to directly ablate the sample and flush the ablated material into the ICP source. In such cases, there is no chemical separation of the desired analyte from the sample matrix and all the specificity has to come from the mass analyzer and the sample introduction system in the mass analyzer. Specificity describes the ability of an analyzer to unambiguously determine and identify a certain species in a sample. One way to achieve specificity in a mass spectrometer is to ensure that the mass resolving power $M/(\Delta M)$ of the mass analyzer is large enough to clearly separate one species from another species where $\Delta M$ is meant to be the mass difference of both species and M is the mass of the species of interest. This requires very high mass resolution in case of isobaric interferences of species with the same nominal mass. For sector field mass spectrometers high mass resolution comes along with using very narrow entrance slits to the mass analyzer and the small entrance slits significantly reduce the transmission and thus the sensitivity of the mass analyzer. As a consequence, this becomes an unpractical approach where very high mass resolving power is required. This is a special challenge for mass spectrometry instrumentation where current technical solutions are limited.

The Inductively Coupled Plasma (ICP) ion source is a very efficient ion source for elemental and isotopic analysis using mass spectrometry. This is an analytical method that is capable of detecting elements at very low concentration, as low as one part in $10^{15}$ (part per quadrillion, ppq) on non-interfered low-background isotopes. The method involves ionizing the sample to be analyzed with an inductively coupled plasma and then using a mass spectrometer to separate and quantify the thus generated ions.

Ionizing a gas, usually argon, in an electromagnetic coil, to generate a highly energized mixture of argon atoms, free electrons and argon ions, generates the plasma, in which the temperature is high enough to cause atomization and ionization of the sample. The ions produced are introduced, via one or more stages of pressure reduction, into a mass analyzer which is most commonly a quadrupole analyzer, a magnetic sector analyzer or a time-of-flight analyzer.

High precision mass analyzers allow for high mass resolution to separate elemental ions from molecular species which to some extent are inevitably formed inside the ICP source (e.g. $OH^+$, $NO^+$, $CO^+$, $CO_2^+$, $ArO^+$, $ArN^+$, $ArAr^+$, etc.) and interfere with elemental ions. Thus, certain elements are known to have relatively poor detection limits by ICP-MS. These are predominantly those that suffer from artefacts or spectral interferences generated by ions that are derived from the plasma gas, matrix components or the solvent used to solubilize samples. Examples include $^{40}Ar^{16}O$ for determination of $^{56}Fe$, $^{38}ArH$ for determination of $^{39}K$, $^{40}Ar$ for determination of $^{40}Ca$, $^{40}Ar^{40}Ar$ for determination of $^{80}Se$, $^{40}Ar^{35}Cl$ for determination of $^{75}As$, $^{40}Ar^{12}C$ for determination of $^{52}Cr$ and $^{35}Cl^{16}O$ for determination of $^{51}V$.

With a high mass resolution magnetic sector multicollector mass spectrometer the molecular species can be separated along the focal plane of the mass spectrometer so that just the elemental ions can be detected while the molecular interferences are discriminated at the detector slit (see Weyer & Schwieters, International Journal of Mass Spectrometry, Vol. 226, Number 3, May 2003, herein incorporated by reference). This procedure works well for interferences where the relative mass deviation between the analyte and the interference is in the range of (M/ΔM)<2,000-10,000 (M: mass of the analyte, ΔM: mass difference between analyte and interference).

With a sector mass spectrometer high mass resolution usually comes along with reduced ion optical transmission into to the mass analyzer because high mass resolution requires narrower entrance slits and smaller apertures to minimize second or third order angular aberrations further down the ion beam path from the entrance slit to the detector. In the particular case where the amount of sample is limited or the analyte concentration in a sample is low the reduced sensitivity in high mass resolution mode is a significant problem. It directly results in reduced analytical precision because of poorer counting statistics at effectively reduced transmission through the sector field analyzer. Therefore high mass resolution is not generally a practical solution to eliminate interferences and to gain specificity even in cases where the mass resolving power of the mass spectrometer would be sufficient to discriminate the interferences.

There are other applications where isobaric interferences of elemental ions cannot be avoided by sample preparation and where mass resolving power >>10,000 would be required to separate the interfering species. One example is the analysis of $^{40}Ca$ with argon based plasma. There is a strong interference of elemental $^{40}Ar^+$ on $^{40}Ca^+$. The required mass resolution to separate both species would be >193,000 which is much greater than that which can be achieved by a magnetic sector field analyzer.

One solution to this problem is provided by collision cell technology (ICP-CCT) that includes a collision/reaction cell that is positioned before the analyzer. This collision cell adds another possibility to achieve specificity for the analysis. Instead of mass resolving power it uses chemical reactions to distinguish between interfering species. Into this cell, which typically comprises a multipole operating in a radiofrequency mode to focus the ions, a collision gas such as helium or hydrogen is introduced. The collision gas collides and reacts with the ions in the cell, to convert interfering ions to harmless non-interfering species.

A collision cell may be used to remove unwanted artefact ions from an elemental mass spectrum. The use of a collision cell is described, e.g., in EP 6 813 228 A1, WO 97/25737 or U.S. Pat. No. 5,049,739 B, all herein incorporated by reference. A collision cell is a substantially gas-tight enclosure through which ions are transmitted. It is positioned between the ion source and the main mass analyzer. A target gas (molecular and/or atomic) is admitted into the collision cell, with the objective of promoting collisions between ions and the neutral gas molecules or atoms. The collision cell may be a passive cell, as disclosed in U.S. Pat. No. 5,049,739 B, or the ions may be confined in the cell by means of ion optics, for example a multipole which is driven with alternating voltages or a combination of alternating and direct voltages, as in EP 0 813 228. By this means the collision cell can be configured so as to transmit ions with minimal losses, even when the cell is operated at a pressure that is high enough to guarantee many collisions between the ions and the gas molecules.

For example, the use of a collision cell where about 2% $H_2$ is added to He gas inside the cell selectively neutralizes $^{40}Ar^+$ ion by low energy collisions of the $^{40}Ar^+$ with the $H_2$ gas and a resonant charge transfer of an electron from the $H_2$ gas to neutralize the $^{40}Ar^+$ ions (see Tanner, Baranov & Bandura, 2002, Spectrochimica Acta Part B: Atomic Spectroscopy, 57:1361-1452, herein incorporated by reference). This charge transfer mechanism is very selective and efficiently neutralizes argon ions and thus discriminates $^{40}Ar^+$ ions from $^{40}Ca^+$. These types of effects are sometimes called chemical resolution (Tanner & Holland, 2001, in: Plasma Source Mass Spectrometry: The New Millennium, Publisher: Royal Soc of Chem) in comparison to mass resolution in the case of mass spectrometer.

In addition to the charge transfer reaction other mechanisms inside the collision cell using other collision gases or mixtures of collision gases may be applied to reduce interferences. These mechanisms include: kinetic energy discrimination due to collisions inside the collision cell (e.g., Hattendorf & Guenther, 2004, J. Anal Atom Spectroscopy 19:600), herein incorporated by reference), fragmentation of molecular species inside the collision cell (see Koppenaal, D., W., Eiden, G., C. and Barinaga, C., J., (2004), *Collision and reaction cells in atomic mass spectrometry: development, status, and applications*, Journal of Analytical Atomic Spectroscopy, Volume 19, p.: 561-570 herein incorporated by reference), and/or mass shift reactions inside the collision cell. This toolbox of ICP-CCT can come closer to the goal of detection specificity using direct sample analysis with significantly reduced sample preparation but there are still analytical problems and interferences which cannot be resolved by interfacing a collision cell to a mass spectrometer.

By careful control of the conditions in the collision cell, it is possible to transmit the desired ions efficiently. This is possible because in general the desired ions, those that form part of the mass spectrum to be analyzed, are monatomic and carry a single positive charge that is, they have lost an electron. If such an ion collides with a neutral gas atom or molecule, the ion will retain its positive charge unless the first ionization potential of the gas is low enough for an electron to transfer to the ion and neutralize it. Consequently, gases with high ionization potentials are ideal target gases. Conversely, it is possible to remove artefact ions while continuing to transmit the desired ions efficiently. For example the artefact ions may be molecular ions such as $ArO^+$ or $Ar_2^+$ which are much less stable than the atomic ions. In a collision with a neutral gas atom or molecule, a molecular ion may dissociate, forming a new ion of lower mass and one or more neutral fragments. In addition, the collision cross section for collisions involving a molecular ion tends to be greater than for an atomic ion. This was demonstrated by Douglas (Canadian Journal Spectroscopy, 1989 vol 34(2) pp 36-49), incorporated herein by reference. Another possibility is to utilize reactive collisions. Eiden et al. (Journal of Analytical Atomic Spectrometry vol 11 pp 317-322 (1996)) used hydrogen to eliminate many molecular ions and also $Ar^+$, while monatomic analyte ions remain largely unaffected.

SUMMARY OF THE INVENTION

The present invention addresses ways to facilitate the mass spectrometry analysis of molecular and/or elemental species that suffer from interference by isobaric species, by inducing mass shift reactions within the ICP source to generate mass-shifted ionic molecular species. Through the mass analysis of such mass-shifted molecular species, or fragments or further molecular adducts thereof, the invention provides means of determining the mass spectrum of the analytical species of interest on an interference-free background.

In one aspect, the present invention provides a method of inductively coupled plasma mass spectrometry (ICP-MS), comprising a. providing at least one inductively coupled plasma source;

b. introducing at least one sample comprising at least one sample species, and at least one reactive species, into the plasma source, such that at least one molecular adduct ion of the at least one reactive species and the at least one sample species is formed;

c. transferring the at least one molecular adduct ion into a collision cell that is arranged between the inductively coupled plasma source and at least one mass analyzer, d. transferring the at least one molecular adduct ion, or a product thereof, into the at least one mass analyzer, and analyzing the mass of the at least one molecular adduct ion, or the product thereof, in the at least one mass analyzer.

The method can further comprise transferring the at least one molecular adduct ion that is formed in the inductively coupled plasma source through at least one mass filter that is provided between the inductively coupled plasma source and the collision cell, and that is configured to only transmit ions with a mass-to-charge ratio in a range that includes the mass-to-charge ratio of the molecular adduct ion of the reactive species and the sample species.

The invention furthermore relates to an inductively coupled plasma mass spectrometer (ICP-MS), comprising a. at least one sample introduction device;

b. an inductively coupled plasma source;

c. at least one mass filter, d. at least one collision cell, and e. at least one mass analyzer;

wherein the at least one mass filter is arranged between the inductively coupled plasma source and the collision cell, and wherein the spectrometer further comprises at least one sample introduction system for delivering at least one reactive species into the inductively coupled plasma source, whereby the reactive species forms at least one molecular adduct ion with at least one ion generated from a sample in the inductively coupled plasma source.

The sample introduction device can comprise one or more devices that are known in the art for providing samples into an ICP source. The device can be adapted for providing liquid, solid or gas samples into the ICP source. The device can for example comprise one or more pneumatic concentric or cross-flow nebulizer, ultrasonic nebulizer and/or laser ablation source.

The sample introduction system can comprise one or more components that are suitable for delivering reactive species into the ICP source. The system can in some embodiments comprise one or more gastight connections for delivering a reaction gas into the ICP source. The system can be adapted to deliver a reaction gas directly into ICP source. Alternatively, or additionally, the system can be adapted to deliver a reactive species into the sample introduction device.

The product ion (formed in the collision cell) of the molecular adduct ion that is formed in the ICP source can in general be a fragment of the molecular adduct ion, or the product can be a further molecular adduct ion, that is generated through a chemical reaction with a further reactive species in the collision cell.

Accordingly, in certain embodiments, the method according to the invention can comprise further steps of d. introducing at least one gas into the collision cell;

e. forming at least one product ion in the collision cell from the at least one molecular adduct ion and the at least one gas;

f. transferring the at least one product ion into the at least one mass analyzer; and g. analyzing mass of the at least one product ion in the at least one mass analyzer.

The at least one gas can comprise one or more collision gas. The at least one gas can also be a reactive gas that comprises one or more reactive species. In one embodiment, the reactive gas comprises a single reactive species. In another embodiment, the reactive gas comprises a mixture comprising two or more reactive species.

An inductively coupled plasma (ICP) source is a plasma source in which energy is supplied by electric currents which are produced by electromagnetic induction, that is, by time-varying magnetic fields. The inductively coupled plasma (ICP) source can be any such source that is known to the skilled person. For example, the ICP source comprises a plasma torch that comprises three concentric tubes, which can for example be made from quartz. The ICP source can further comprise an electrode that has a helical shape and that, when a time-varying electric current is applied thereto, will create a time-varying magnetic field. The ICP source can be adapted to be operable with any suitable gas for plasma generation, such as argon gas.

A common analytical challenge in mass spectrometry relates to the presence of interfering ions that have the same or very similar mass as the ion that is being analyzed (a sample ion). The present invention provides a method to eliminate the effects such interferences on the mass spectrum of the sample species of interest. For example, at least one interfering ion having the same mass as the molecular adduct ion may form in the inductively coupled plasma source. The interfering sample ion can for example be another molecular adduct ion that is formed in the ICP source. The interfering ion can also be an ion that originates from the plasma gas or from the apparatus itself, and that is released in the plasma gas. The method according to the invention provides an apparatus and method for minimizing the effects of such interfering ions, through a sequential process that can involve one or more step such as: formation of one or more molecular adduct ion, mass filtering and fragmentation and/or reaction.

For example, the method can comprise further fragmenting the at least one interfering sample ion, but not the molecular adduct ion that is formed in the ICP source, in the collision cell. As a consequence, the mass of the molecular adduct ion is analyzed in the mass spectrometer, but not the mass of the fragmented interfering ion. Preferably, the mass filter is used to transmit only a limited range of mass to charge ratios from the ICP source to the collision cell including the mass to charge ratio of the molecular adduct ion.

In another example, the method can comprise fragmenting the molecular adduct ion that is formed in the ICP source, but not the at least one interfering ion, in the collision cell. In this way, the molecular adduct ion may be fragmented to yield the sample species (at lower mass) from which the molecular adduct ion was formed in the ICP source. As a consequence, the mass of the sample species ion is analyzed in the mass spectrometer, which is no longer interfered by the mass of the interfering ion. Preferably, the mass filter is used to transmit only a limited range of mass to charge ratios from the ICP source to the collision cell including the mass to charge ratio of the molecular adduct ion. Thereby the sample species (at lower mass) produced in the collision cell appears on a non-interfered background in the mass spectrum measured by the mass analyzer.

A molecular adduct ion can be formed through the reaction of a reactive species that is present in, or is added to, the inductively coupled plasma source. The reactive species can be any atomic or molecular species that is capable of forming a molecular adduct ion with at least one sample species, which can either be an atomic or molecular species. In some embodiments, the reactive species is selected from the group consisting of $H_2$, $N_2$, $O_2$, $NH_3$, $SO_2$, $CS_2$, $N_2O$, $SF_6$, Ne, Kr, and $CO_2$. By way of example, $O_2$ can form metal oxides such as FeO, VO, CaO, TiO, CrO, BaO, ScO, and $N_2$ can form nitrides with metals, such as FeN, CrN, ArN, VN, NbN, ZrN. Through different rates of formation of such adducts, and/or through their specific fragmentation in a collision cell, it is possible to remove isobaric interferences and thereby increase the sensitivity of the mass analysis.

In certain embodiments, the sample species is an elemental species.

It can also be advantageous to use a mixture of reaction species that can have different reaction affinities for the sample ions and interfering ions that are present in the ICP source. For example, one reactive species may react with the sample ions but also, at least partially, with the interfering ion. By introducing a second reactive species that reacts more rapidly with the interfering ion, but does not react with the sample ion (or reacts very slowly with the sample ions), a selective transformation of the sample ion to a higher-mass molecular species is possible.

In some embodiments, the reactive species is introduced into the inductively coupled plasma source. The sample introduction system of the mass spectrometer can thus comprise at least one reactive gas inlet fluidly connected to the inductively coupled plasma source. The mass spectrometer can also further comprise at least one reactive gas source. The sample introduction system can further comprise at least one sample inlet fluidly connected to the inductively coupled plasma source, which may be the same or a different inlet to the reactive gas inlet.

The reactive species can thus for example be introduced in a plasma generating gas, such as argon, that is introduced into the ICP source. For example, the reactive species can comprise, or consist of, a reactive gas that is mixed into the plasma generating gas that is introduced into the ICP source. The reactive gas can also be introduced separately, i.e. by means of a separate gas connection, into the ICP source. The reaction gas can be introduced into the sample injection tube, the middle tube or the outer tube of a concentric tubular plasma torch ("triaxial torch"). Preferably, the reaction gas is introduced into the sample injection tube. The reaction gas can be introduced together with the sample that is introduced into the injection tube. Alternatively, the reaction gas is introduced via a separate gastight connection that can be used to deliver gas into the injection tube. The reaction gas can also be introduced in the gas that is introduced into the middle (auxiliary gas) tube and/or the outer (cooling gas) tube of the plasma torch, or it can be introduced by means of a separate gastight connection that provides gas into the middle tube and/or the outer tube.

It is known in the art that instrument-dependent parameters, including the tuning of the ICP source, can affect the rate of formation of molecular species in the torch. Such tuning can for example include the position of the torch and flow rates of plasma gas (e.g., Ar) into the ICP source. Thus, the formation of molecular adducts in the ICP source in accordance with the invention can be further controlled by one or more such known methods.

For example, the rate of formation of oxide species in the torch can be influenced by such parameters as nebulizer flow rate (when present), RF power that is applied to the torch, sampler orifice size, the position of the sampler cone in the ICP, the oxygen content in the plasma, and the efficiency of removal of aqueous solvent, when present. In general, increased nebulizer gas flow rates tend to favor increased amount of $MO^+$ and $MOH^+$ species relative to $M^+$ ions (where M represents an atom or molecule). It should be appreciated that these previously known factors that affect the rate of formation of molecular species in the torch can be useful in various embodiments of the present invention, to maximize the formation of desired molecular species in the torch for the particular analysis being undertaken. Preferably, it is arranged in the invention that substantially all, or all, of the at least one sample species forms the at least one molecular adduct ion with the at least one reactive species in the plasma source.

The reactive species can also be present in a sample that contains a sample species that is to be analyzed. For example, the sample can contain reactive species that, when introduced into the ICP source, react with a sample species to form a molecular adduct ion. In general, the molecular adduct ions can thus be generated from ions that are generated from a reaction gas, or from ions in the plasma that originate from the sample itself, an ablated sample matrix (in the case or obtaining a sample by laser ablation), or from impurities in the sample gas. In contrast to the prior art, the present invention maximizes formation of the at least one molecular adduct ion from the at least one sample species.

The reactive species that is introduced into the ICP source can also be introduced as an aerosol. The aerosol can be introduced in a gas, such as a plasma gas. The gas can for example be argon gas. The reactive species can also be introduced into an aerosol that contains the sample to be analyzed and is to be delivered into the ICP source. The aerosol can be generated by any means known in the art. For example, the aerosol can be generated by means of a nebulizer. In some embodiments, the reactive species is introduced into the nebulizer. The reactive species can for example be delivered as a reaction gas that is delivered in or into, the carrier gas. In some embodiments, the sample to be analyzed is introduced into the plasma source by laser ablation. The reactive species can be introduced into the such generated sample as a reactive gas.

It is also possible that molecular adducts are formed from impurities in reaction mixtures used to introduce the sample, for example dilute acid solutions that the samples are introduced in. For example, samples are frequently introduced in dilute acid solutions, e.g. $HNO_3$. Impurities or trace components of such solutions can form molecular adducts with the sample species to be analyzed, so as to form molecular adduct ions in the plasma.

In certain embodiments, it is useful to introduce reaction gas for reactions with molecular species that are not abundant in carrier gas and/or in the plasma. Thus, it can be advantageous to introduce a reaction gas into the ICP source, so as to promote the formation of molecular adduct ions between the introduced reaction gas and sample species in the plasma.

The collision cell typically comprises a multipole operating in a radiofrequency mode, preferably to focus the ions. A collision gas, such as helium or hydrogen, or a reactive gas, such as oxygen or ammonia, is introduced into the cell. The collision gas can collide with the ions introduced to the cell, to convert molecular ions (e.g. in this invention the molecular adduct ions) into smaller molecular ions or elemental ions that are mass shifted to smaller mass and thus can avoid any interference which may have interfered with the molecular ions before fragmentation. The reactive gas can react with elemental ions or molecular ions to mass shift them to higher masses and thereby reduce interference with other ions.

In certain embodiments of the invention, a mass filter is arranged between the ICP source and the collision cell. An advantage of such a configuration is that the mass filter can be set to transmit ions in a mass range that does not include the mass of the ion species (e.g., the product ion(s)) that are mass analyzed in the mass analyzer, thereby promoting the generation of an interference-free mass spectrum in the downstream mass analyzer. Thus, in some embodiments, the mass filter is set to transmit ions with a mass-to-charge ratio that includes the mass-to-charge ratio of the molecular adduct ions that are formed in the ICP source, i.e. the molecular adduct ions formed from the sample species to be mass analyzed.

The mass filter can be a mass filter that comprises electrodes that are provided with a combination of RF and DC voltages in a mass-to-charge (m/z) filtering mode, and are provided with substantially only RF voltage in a non-filtering mode. In other words, the non-filtering mode is preferably an RF-only mode. In this mode, the ions of all mass to charge ratios are stable within the mass filter and as a consequence will be transmitted through it. It is possible that a small DC voltage be applied to the electrodes, in addition to the RF voltage, during the transmission mode. Preferably, the DC/RF voltage ratio in the non-filtering mode is 0.0 (i.e., RF only, no DC voltage), or no more than 0.001, or no more than 0.01, or no more than 0.05, or no more than 0.1. Preferably, the DC/RF ratio is 0.0.

Preferably, the mass filter is a multipole filter. The electrodes of the mass filter are therefore preferably the rods of a multipole mass filter. The multipole can be a quadrupole, a hexapole, or an octopole. Preferably, the multipole is a quadrupole. The quadrupole can be a three-dimensional quadrupole or it can be a two-dimensional, i.e., linear, quadrupole. Preferably, the quadrupole is a linear quadrupole mass filter. The rods of the multipole can be round rods, or they can be hyperbolic rods.

The molecular adduct ions can subsequently be reacted in the collision cell, to generate fragments and/or further molecular adduct ions of the molecular adduct ions that are formed in the ICP source. Such fragment ions and/or further molecular adduct ions are herein referred to as product ions. Thus, in some embodiments, the molecular adduct ions are fragmented in the collision cell, through the introduction of a collision gas into the collision cell. The thus generated product ions, which have a lower mass than the molecular adduct ions, are subsequently transferred into the mass analyzer, where they are mass analyzed on an interference free background. For example, He is a commonly used collision gas, and its introduction into the collision cell can result in the fragmentation of molecular species that are introduced into the cell. By way of example, FeN ions that are formed in the ICP source can be fragmented through the collision with He molecules, resulting in the formation of $Fe^+$ ions and uncharged N atoms. The thus generated $Fe^+$ ions can subsequently be mass analyzed in the mass analyzer.

In one type of embodiment the sample contains at least one first elemental species that it is desired to analyze and optionally at least a second species that interferes (by having substantially the same mass/charge) with the first elemental species. Metal elemental species are typically the species that it is desired to analyze. The reactive species preferably forms a molecular adduct ion with the at least one first elemental species in the ICP source. Preferably, the formation of the molecular adduct ion is maximized so that substantially all, or all, of the first elemental species that it is desired to analyze is converted to the molecular adduct ion. The reactive species may be oxygen such that the molecular adduct ion is an oxide ion, typically a metal oxide ion. The reactive species may be nitrogen such the molecular adduct ion is a nitride ion, typically a metal nitride ion. The mass filter is preferably operated or configured so that it is set to only transmit a mass range that includes the mass of molecular adduct ion formed in the ICP source, e.g. the aforesaid oxide ion or nitride ion (and not a mass range that includes the mass of the unreacted first elemental species). The transmitted mass range may have a width of 24 amu, or 16 amu, or 12 amu, or 8 amu, or 4 amu, or 2 amu, or 1 amu or less, preferably centered on the mass of the molecular adduct ion. The collision cell is preferably configured to contain collision gas such that the molecular adduct ion received from the mass filter is fragmented to generate an ion of the first elemental species. Such first elemental ions, being of a mass not transmitted by the mass filter, are then mass analyzed in the mass analyzer on a clean, interference free, spectral background. For example, in some embodiments, a second species (elemental or molecular) may interfere with the first elemental species in the mass spectrum. However, the second species does not react, or reacts substantially less efficiently, with the reactive species in the ICP source such that it remains substantially as unreacted ions of the second species. Thus, the second species is not transmitted by the mass filter (which transmits a different, limited mass range that includes the molecular adduct ion formed from the first elemental species) and therefore cannot interfere with the subsequent detection of the first elemental species in the mass analyzer (after the first elemental species is generated once again in the collision cell).

In some other embodiments, the transmitted molecular ions can form further molecular adduct ions through molecular collisions with a reaction gas in the collision cell, and that are subsequently mass analyzed in the mass analyzer, largely interference free, especially when a mass filter is employed upstream of the collision cell that does not transmit ions of the mass to charge ratio of the further molecular adduct ions. In this scenario, a further molecular adduct ion that has an increased mass-to-charge ratio is generated, which again can be mass analyzed in the downstream mass analyzer, on an interference-free background.

The underlying benefit of these applications results from the selective transmission of ions through the mass filter with a mass-to-charge ratio that does not include the mass of ions of the product ions that are subsequently transferred into the mass analyzer, thus minimizing the interfering effect of isobaric species (i.e. isobaric with the product ions) that are formed, or are present, in the ICP source.

Thus, the mass filter can be configured to transmit ion species with a mass-to-charge ratio in a range that includes the mass-to-charge ratio of the molecular adduct ion that is formed in the inductively coupled plasma source but does not include the mass-to-charge ratio of product ions that are formed in the collision cell.

In general, the mass filter can be configured to only transmit ions with any desirable mass-to-charge ratio. In some embodiments, the range of mass-to-charge ratio transmitted by the mass filter has a width not greater than 24 amu, or 16 amu, or 12 amu, or 8 amu, or 4 amu, or 2 amu, or 1 amu. In some configurations, the mass filter is configured to only transmit ion species with substantially the mass-to-charge ratios of the molecular adduct ions formed in the inductively coupled plasma source.

There can also be at least one electrostatic lens arranged in the mass spectrometer, such as that described in co-pending UK patent application No. 1514479.3, the entire contents of which are hereby incorporated by reference. The lens is preferably a dual-mode electrostatic lens, for selectively and alternately transmitting or reflecting an ion beam. The electrostatic lens can be arranged upstream from the collision cell, between the ICP source and the collision cell. The electrostatic lens can also be arranged downstream from the collision cell, between the collision cell and the mass analyzer. Preferably, the electrostatic lens is arranged between the collision cell and the mass filter.

The electrostatic lens can be configured so that the lens has two modes of function, wherein during a first mode, the lens transmits an ion beam than enters the lens along a first axis through the lens. When arranged upstream from the collision cell, the lens will in this mode transmit an ion beam that enters the collision cell. In a second mode, the lens can reflect an incoming ion beam backwards and towards the side, with respect to the direction and motion of the incoming beam, and into an off-axis detector. When the upstream mass filter is operated in a scanning, rather than static, mass-filtering mode, for example in a mass-filtering mode where the mass filter scans mass windows of less than 1 amu for obtaining a mass spectrum across a range of masses (i.e. mass to charge ratios), ions that are transmitted by the mass filter will be reflected in the electrostatic lens and into the off-axis detector. In this way a full mass spectrum can be obtained.

In addition to being either transmitted or reflected in the electrostatic lens, the ion beam is also focused when transmitted and/or directed backwards towards the side of the assembly, into the collision cell or into the detector.

The off-axis detector can be any type of detector that is typically used in mass spectrometry, such as an electron multiplier (continuous or discrete), also called SEM (Secondary Electron Multiplier) detector, an array detector, a Faraday cup, a photon counter, a scintillation detector, or any other detector that is useful for detecting ions, in particular in the context of a mass spectrometer. Preferably, the detector is capable of fast time response. The detector can therefore preferably be an electron multiplier, such as a continuous dynode multiplier or a discrete dynode multiplier.

Switching time between a normal (transmission) mode and a reflection mode of the electrostatic lens is preferably short. The switching time can be less than 5 ms, less than 4 ms, less than 3 ms, less than 2 ms, less than 1 ms, less than 0.5 ms, less than 0.2 ms or less than 0.1 ms. Preferably, the switching time is less than 1 ms.

The detector can be placed upstream from the lens assembly, adjacent to the upstream mass filter, i.e. closer to the mass filter than to the collision cell. Such an arrangement benefits from the superior vacuum in the vicinity of the mass filter, compared with a downstream arrangement, for example near the collision cell, where vacuum conditions are relatively poor. As a consequence, superior detection conditions will be provided, irrespective of whether a downstream collision cell is being pressurized with collision gas or not.

The setup has a further advantage that a mass spectrum of an incoming ion beam can be rapidly determined, using the first mass filter (e.g., a quadrupole operated in a scanning mode), wherein during the reflection mode, the electrostatic lens is set to reflect the incoming ion beam backwards into the detector. During this time, a full mass spectrum, or a mass spectrum within a predetermined mass region, of an incoming beam can be determined. Such a scan can provide important information about the composition of the sample being analyzed, for example for a mass analysis of molecular adduct ions formed in the ICP source or for a mass analysis of sample ions before a reactive gas is introduced into the ICP source. Following the mass scan, which is very fast when the first mass filter is a multipole, a switch to a second mode of a downstream mass filter can be performed, for example for determining the mass of the molecular adduct ion or a product ion (e.g., fragment ion or further molecular adduct ion), such as an isotope ratio. This setup has distinct advantages over present solutions, in which a sample has to be split, e.g. into two separate instruments, for different type of mass analysis in the two instruments.

The collision cell further can comprise at least one gas inlet for admitting at least one gas into the collision cell. The gas can be a reaction and/or a collision gas. For example, the gas can be selected from He, $H_2$, $O_2$, $NH_3$, and $SO_2$ or mixtures of any two or more thereof.

The method and apparatus in accordance with the invention can be implemented on mass spectrometers that include any type of mass analyzer downstream of the collision cell. For example, the mass analyzer can be a sector analyzer. The mass analyzer can also be, or comprise, a quadrupole mass analyzer, or a time of flight mass analyzer, or an ion trap analyzer, or a Fourier transform mass spectrometer, or an orbital trapping analyzer. The sector analyzer, when present, can comprise a multicollector, and such a sector analyzer can preferably be configured to analyzer isotope composition of product ions that are transmitted into the analyzer.

The mass spectrometer preferably comprises at least one power supply and at least one electronic controller, for regulating the electric potential applied to various components of the instrument, including ICP source, ion guides, including the collision cell, mass filters, mass analyzer and detectors, and the elongated rods of the collision cell multipole.

In some embodiments, the controller is configured to operate the spectrometer such that the at least one molecular adduct ion formed in the inductively coupled plasma source is transmitted by the mass filter to the collision cell. In one such embodiment, a product ion is formed in the collision cell from the at least one molecular adduct ion, wherein the product ion has a mass-to-charge ratio that is not transmitted by the mass filter, and wherein the product ion is mass analyzed in the mass analyzer. The controller can further control operation of the electrostatic lens, when present.

The controller can further comprise at least one processor and at least one computer program for execution by the processor, wherein the computer program when executed causes the processor to operate the spectrometer as described herein.

The above features along with additional details of the invention are described further in the examples below, which are intended to further illustrate the invention but are not intended to limit its scope in any way.

DETAILED DESCRIPTION OF EMBODIMENTS

In the following, exemplary embodiments of the invention will be described, referring to the figures. These examples are provided to provide further understanding of the invention, without limiting its scope.

In the following description, a series of steps are described. The skilled person will appreciate that unless required by the context, the order of steps is not critical for the resulting configuration and its effect. Further, it will be apparent to the skilled person that irrespective of the order of steps, the presence or absence of time delay between steps, can be present between some or all of the described steps.

It should be appreciated that the invention is applicable for mass analysis of materials in general, such as gases, liquids, solids, particles and aerosols. In general, therefore, the sample that is being analyzed in the system will be variable.

Figure 1:
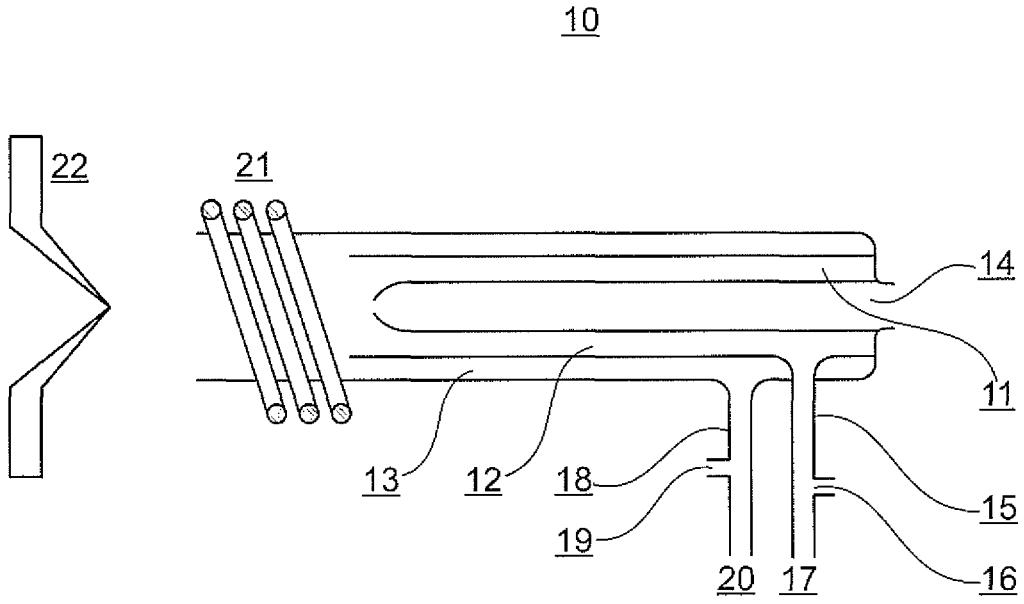
FIG. 1 shows an Inductively Coupled Plasma (ICP) source in accordance with the invention, indicating two alternate configurations for introduction of reaction gas into the ICP source

An Inductively Coupled Plasma (ICP) source 10 in accordance with the invention is shown in FIG. 1. The ICP source exemplified contains three concentric tubes 11, 12, 13 which are typically made from quartz, and a load coil 21. Plasma gas can be introduced through the sample inlet 14, an auxiliary gas inlet 17 via an auxiliary gas line 15 and/or a cooling gas inlet 20 via a cooling gas line 18. The plasma is then sampled through a cone 22 before entering downstream ion optics of the mass spectrometer (not shown).

A sample is introduced through the sample inlet 14, typically in a plasma gas such as Argon. The sample can be an aerosol that is generated by a means of a nebulizer and a spray chamber, as further illustrated in FIG. 2. The reactive species gas can be introduced into the ICP source through the sample inlet 14 together with the sample, either in a gaseous form in mixture with the plasma gas, or in liquid form in the sample aerosol, when present. Alternatively, or additionally, the reactive species can be introduced as a reactive gas via inlets 16, 19 on the auxiliary gas inlet line 17 and/or the cooling gas inlet line 20, respectively.

Figure 2:
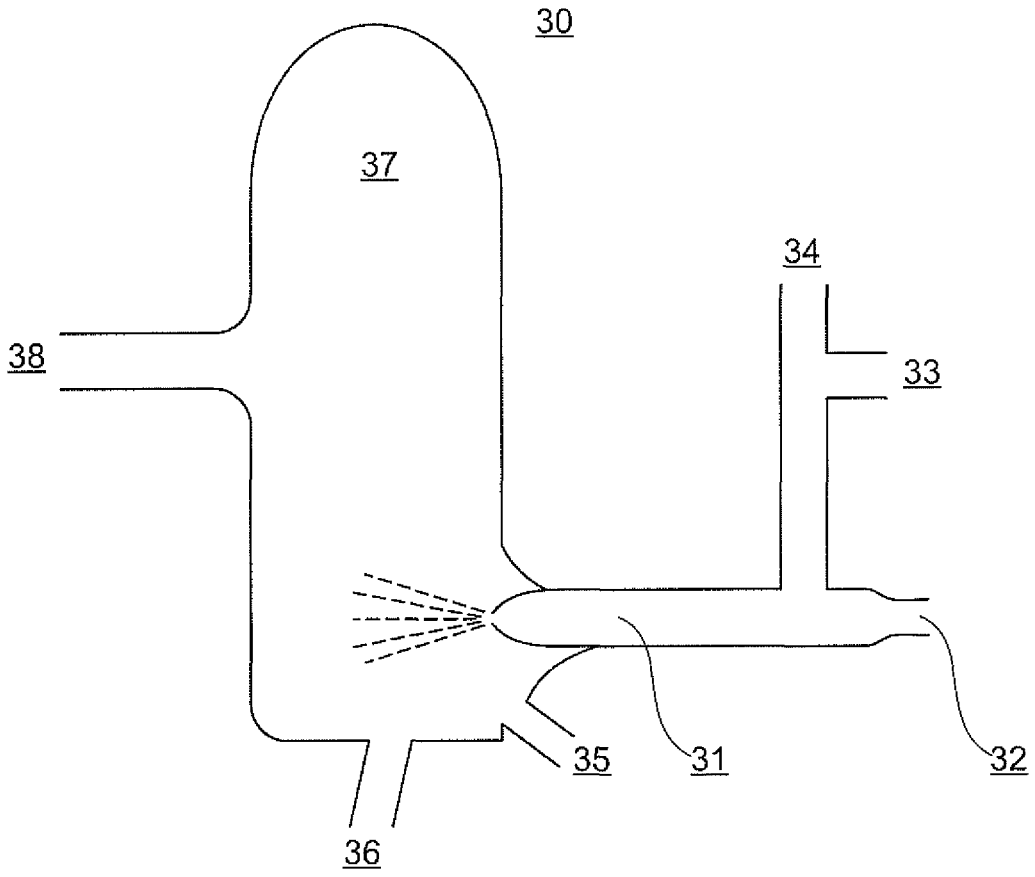
FIG. 2 shows a sample introduction system that consists of a nebulizer and a spray chamber, for introducing an aerosol into the ICP source. Two alternate configurations for introducing a reactive species into the sample introduction system are indicated.

The reactive species can also be introduced into a sample introduction system such as a spray chamber assembly 30, as illustrated in FIG. 2. The assembly includes a nebulizer 31, which has a sample inlet 32, and a nebulizer gas inlet 34, which typically will be identical to the plasma gas (such as Argon). An inlet 33 can be provided on the nebulizer gas inlet, and that can be used to provide a reactive gas, in mixture with the nebulizer gas, into the nebulizer.

The nebulizer delivers a sample spray into the spray chamber 37, which has a drain 36 and an outlet 38 that feeds into the sample inlet 14 of the ICP source 10. The spray chamber can further have a gas inlet 35 that can be used to deliver reaction gas into the spray chamber, where it will form a mixture with the sample aerosol and be delivered into the ICP source through the outlet 38.

Thus, alternative embodiments for delivering sample gas into the spray chamber assembly are possible. These embodiments can be used alternatively, or they can be used in combination.

A variety of factors including temperature, nebulizer flow rate, RF power that is applied to the torch, and concentration of the reactive species are expected to influence the rate of formation of molecular adduct ions that result from reaction between a sample species and a reactive species. Thus, depending on the nature of the reactive and sample species, and the desirable adduct ion, the appropriate configuration for introducing the reactive species can be selected, i.e. through one or more such inlets on the spray chamber assembly or the ICP source. Additional parameters, including the rate of introduction of the reactive species, can be optimized so as to maximize the yield of the molecular adduct ion in the ICP source.

It should be appreciated that it can be advantageous to use more than one inlet for delivering reactive species into the ICP source simultaneously. More than one inlet can be used simultaneously, either for delivering the same reactive species, or alternatively for delivering different reactive species, which subsequently can form distinct molecular ion adducts in the ICP source.

Figure 3:
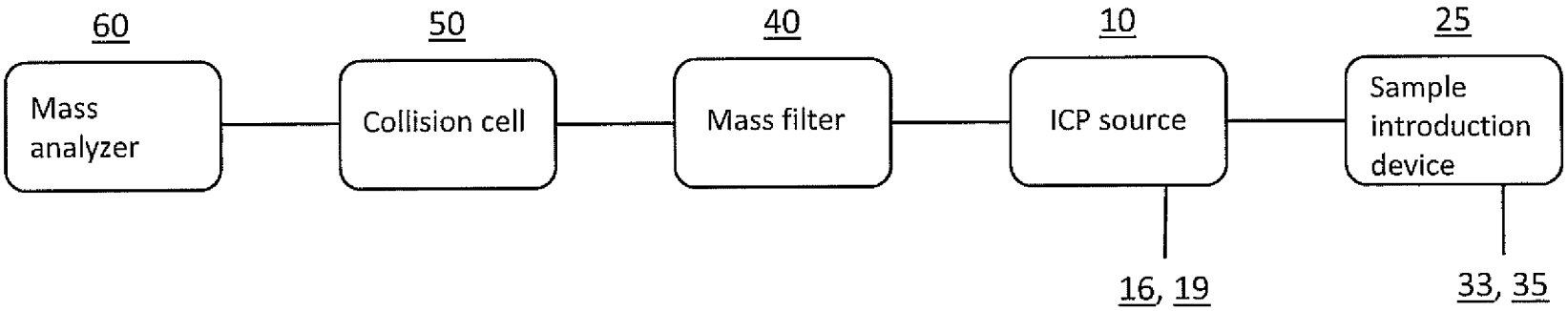
FIG. 3 shows a mass spectrometer in accordance with the invention, the mass spectrometer consisting of a sample introduction system, an ICP source, a mass filter, a collision cell and a mass analyzer. As indicated, the sample introduction system and/or the ICP source can have a connection for introduction of a reaction gas, as further illustrated in FIG. 1 and FIG. 2.

Turning to FIG. 3, a mass spectrometer in accordance with the invention is shown. The mass spectrometer includes a sample introduction system 25, and an ICP source 10. Reactive species can be introduced through one or more inlets 16, 19, 33, 35, as described in the above with respect to FIG. 1 and FIG. 2. The mass spectrometer further contains a mass filter 40. The mass filter can be configured to selectively transmit molecular adduct ions formed in the inductively coupled plasma source (and optionally ions in a limited mass range about the mass-to-charge ratio of the adduct ions), but not ions that have a smaller or larger mass-to-charge ratio than the selected transmitted range. As a consequence, mass analysis of the molecular adduct ion or a fragment thereof in the downstream mass analyzer can be performed free of isobaric interferences, e.g. after mass shifting reactions or fragmentations in the collision cell as described further below.

Downstream of the mass analyzer, collision cell 50 is arranged. By the introduction of a collision gas into the collision cell, molecular adduct ions that are formed in the ICP source and that are transferred into the collision cell can be fragmented, so as to generate sample or product ions (e.g. sample ions from which the molecular adduct ions were formed in the source by reaction of the sample ions with the reactive species). Alternatively, further molecular adduction ions of molecular adduct ions that are transmitted into the collision cell can be generated, by reaction with a reaction gas that is provided in the collision cell. The mass of sample ions or further molecular ions thus generated can subsequently be determined in the downstream mass analyzer 60 free from interferences due to the use of the mass filter.

A distinct advantage of this setup is the possibility to remove isobaric interferences. Thus, the selective transmission by the mass filter of molecular adduct ions having a mass-to-charge ratio that does not include the mass-to-charge ratio of isobaric interferences of the sample ions that may be present or be generated in the ICP source, mass analysis of sample ions (that is formed by fragmentation of molecular adduct ions in the collision cell), or molecular adduct ions, can be performed in the absence of such interferences. The result is a mass spectrum with improved specificity.

Molecular adduct ions can be formed within ICP source at different rates. For example, rate of oxide formation is highly variable, leading to the possibility to selectively form metal oxides to eliminate isobaric interferences. By way of example, Ti oxides form about 100 times faster than Ca oxides. As a consequence, the invention will find general application for removal of interferences on different molecular and/or elemental background, where the interfering ion(s) and the sample ions have different reaction probabilities.

The following non-limiting examples provide exemplary descriptions of certain analytical benefits of the present invention.

Example 1

Introduction of $O_2$ into the ICP source preferentially leads to the formation of TiO over CaO. The metal oxide that is formed in the ICP source is fragmented in the collision cell, leading to the formation of elemental ions that is mass analyzed in the downstream mass analyzer. When analyzed on a mass spec that has a mass filter upstream of the collision cell, the mass filter is preferably set to only transmit oxides in a mass range that includes TiO. This means that potential interferences on Ti isotope analysis are not transmitted by the mass filter, leading to reduced interference on the mass spectrum.

The mass filter can be set to only transmit adduct ions that are formed in the ICP source (e.g. oxidized species, nitrogen adducts, etc.) but not the mass of the product ions that are produced in the collision cell. Adduct ions can be broken into smaller mass product ions in the collision cell so that products appear at a smaller mass which was not transmitted by the first mass filter. By doing this it is possible to mass analyze the smaller mass (e.g. elemental) ion on a clean background in the downstream mass analyzer. For example, the aforesaid transmitted TiO oxides can be fragmented to Ti ions in the collision cell and subsequently measured on an interference-free background in the mass analyzer.

Example 2

In an isotope ratio analysis of Fe on an interfering background of Cr species, the addition of $N_2$ to ICP source, for example to the nebulizer, leads to formation of FeN and CrN. However, the rate of formation of FeN is much greater than for CrN, which means that the molecular adduct ions formed in the ICP source will be predominantly FeN species. Other interferences can include $^{40}Ar^{16}O$ on $^{56}Fe$ and $^{46}Ar^{14}N$ on $^{54}Fe$. Mass filter can be set to transmit only masses 63 to 73, i.e. the mass filter does not transmit the interfering $^{40}Ar^{16}O$ and $^{40}Ar^{14}N$ species and also not unreacted Cr isotopes. The transmitted FeN species is fragmented by adding a collision gas such as He to the collision cell, leading to the formation of elemental Fe isotopes, which are mass analyzed in the downstream mass analyzer.

Adduct ions that are transmitted by the mass filter can also be converted into further molecular adducts in the collision cell. Thereby, it is possible to mass analyze a larger mass ion on a clean background in the downstream mass analyzer.

Example 3

The mass filter is controlled to only transmit ions with a mass-to-charge ratio in a range that includes the mass-to-charge ratio of molecular adduct ions formed in the ICP source, for example a mass window of 16 amu centered around $^{48}Ti^{16}O$ that has a mass of 64. The transmitted adduct ions are further reacted into larger mass product ions in the collision cell. The further molecular adduct species (i.e. the larger mass product ions) are subsequently transmitted into the mass analyzer, where their mass is analyzed on a clean background. For example, background interference by Ca, V and/or Cr species can be problematic during analysis of $^{48}Ti^{16}O$. To overcome such interference, a further reaction of $^{48}Ti^{16}O$ with $CO_2$ can be done in the collision cell, generating higher molecular weight species that can be mass analyzed in the absence of interferences.

Example 4

Here, molecular adduct ions derived from the sample that are formed in the ICP source are transmitted through the collision cell, while interfering molecular adduct ions are fragmented in the collision cell, so that the molecular adduct can be mass analyzed in the downstream mass analyzer on a clean background. This mode of operation is also possible in an instrument having a mass filter upstream of the collision cell, for removal of other potentially interfering species, for example higher molecular weight species that could be fragmented in the collision cell, forming fragments that could interfere on the mass spectrum of the sample molecular adduct ion.

In summary, the present invention provides numerous advantages, including:

a. improved sensitivity of mass analysis, due to elimination of isobaric interfering species;
b. selective mass-shifting within the inductively coupled plasma source, to allow for removal of isobaric species;
c. providing a mass filter upstream of the collision cell so as to only transmit ions with a mass-to-charge ratio that does not include the mass-to-charge ratio of the mass analyzed (product ion) species;
d. selective fragmentation of molecular species transmitted by the mass filter into the collision cell, leading to mass analysis of mass-shifted species having a lower mass than transmitted by the mass filter;
e. selective formation of molecular adducts in the collision cell, leading to mass analysis of mass-shifted species having a greater mass than transmitted by the mass filter.

As used herein, including in the claims, singular forms of terms are to be construed as also including the plural form and vice versa, unless the context indicates otherwise. Thus, it should be noted that as used herein, the singular forms "a," "an," and "the" include plural references unless the context clearly dictates otherwise.

Throughout the description and claims, the terms "comprise", "including", "having", and "contain" and their variations should be understood as meaning "including but not limited to", and are not intended to exclude other components.

The present invention also covers the exact terms, features, values and ranges etc. in case these terms, features, values and ranges etc. are used in conjunction with terms such as about, around, generally, substantially, essentially, at least etc. (i.e., "about 3" shall also cover exactly 3 or "substantially constant" shall also cover exactly constant).

The term "at least one" should be understood as meaning "one or more", and therefore includes both embodiments that include one or multiple components. Furthermore, dependent claims that refer to independent claims that describe features with "at least one" have the same meaning, both when the feature is referred to as "the" and "the at least one".

It will be appreciated that variations to the foregoing embodiments of the invention can be made while still falling within the scope of the invention can be made while still falling within scope of the invention. Features disclosed in the specification, unless stated otherwise, can be replaced by alternative features serving the same, equivalent or similar purpose. Thus, unless stated otherwise, each feature disclosed represents one example of a generic series of equivalent or similar features.

Use of exemplary language, such as "for instance", "such as", "for example" and the like, is merely intended to better illustrate the invention and does not indicate a limitation on the scope of the invention unless so claimed. Any steps described in the specification may be performed in any order or simultaneously, unless the context clearly indicates otherwise.

All of the features and/or steps disclosed in the specification can be combined in any combination, except for combinations where at least some of the features and/or steps are mutually exclusive. In particular, preferred features of the invention are applicable to all aspects of the invention and may be used in any combination.

The invention claimed is:

1. A method of inductively coupled plasma mass spectrometry (ICP-MS), comprising:

a. providing at least one inductively coupled plasma source;

b. introducing at least one sample comprising at least one sample species, and at least one reactive species, into the plasma source, such that at least one molecular adduct ion of the at least one reactive species and the at least one sample species is formed;

c. transferring the at least one molecular adduct ion into a collision cell that is arranged between the inductively coupled plasma source and at least one mass analyzer, d. transferring the at least one molecular adduct ion, or a product thereof, into the at least one mass analyzer, and e. analyzing the mass of the at least one molecular adduct ion, or the product thereof, in the at least one mass analyzer, wherein the sample contains a plurality of interfering isotopes having the same nominal mass and wherein a molecular adduct ion is formed in the plasma source from one of the interfering isotopes at a higher rate than from the other interfering isotope(s).

2. The method of claim 1, wherein the product is a fragment ion or a further molecular adduct ion.

3. The method of claim 1, wherein at least one interfering sample ion having the same mass as the molecular adduction ion is formed in the inductively coupled plasma source, and wherein the method further comprises fragmenting the at least one interfering sample ion but not the molecular adduct ion in the collision cell.

4. The method of claim 1, further comprising a. introducing at least one gas into the collision cell;

b. forming at least one product ion in the collision cell from the at least one molecular adduct ion and the at least one gas;

c. transferring the at least one product ion into the at least one mass analyzer; and d. analyzing mass of the at least one product ion in the at least one mass analyzer.

5. The method of claim 4, wherein the product ion is formed in the collision cell by fragmenting the molecular adduct ion by the introduction of at least one collision gas in the collision cell, to generate at least one fragment ion that represents the product ion, and/or by reacting the molecular adduct ion by the introduction of at least one reactive gas in the collision cell, to generate at least one further molecular adduct ion from the molecular adduct ion and the reactive gas, that represents the product ion.

6. The method of claim 1, further comprising transferring the at least one molecular adduct ion that is formed in the inductively coupled plasma source through at least one mass filter that is provided between the inductively coupled plasma source and the collision cell, and that is configured to only transmit ions with a mass-to-charge ratio in a range that includes the mass-to-charge ratio of the at least one molecular adduct ion.

7. The method of claim 6, wherein the mass filter is configured to transmit ion species with a mass-to-charge ratio in a range that includes the mass-to-charge ratio of the molecular adduct ion.

8. The method of claim 6, wherein the mass filter is configured to not transmit ions with mass-to-charge ratio of molecular adduct and/or fragment ions that are produced in the collision cell.

9. The method of claim 6, wherein the mass-to-charge ratios transmitted by the mass filter has a width not greater than 24 amu.

10. The method of claim 6, wherein the mass filter is configured to only transmit ion species with substantially the mass-to-charge ratios of the molecular adduct ions formed in the inductively coupled plasma source.

11. The method of claim 1, wherein the sample and/or the reactive species are provided in a gas that is introduced into the plasma source.

12. The method of claim 1, wherein the sample species is an elemental species.

13. The method of claim 1, wherein the at least one reactive species is provided as at least one reactive gas that is introduced into the plasma source.

14. The method of claim 1, wherein the mass analyzer is a sector analyzer, optionally having a multicollector, and wherein analyzing the mass comprises determining an isotope composition.

15. The method of claim 1, wherein the sample is introduced into the plasma source as an aerosol in a carrier gas.

16. The method of claim 15, wherein the reactive species is introduced into the aerosol.

17. The method of claim 1, wherein the sample is introduced into the plasma source by laser ablation.

18. The method of claim 1, wherein the reactive species is selected from $H_2$, $N_2$, $O_2$, $NH_3$, $SO_2$, $CS_2$, $N_2O$, $SF_6$, Ne, Kr, $CO_2$.

19. An inductively coupled plasma mass spectrometer (ICP-MS), comprising:

a. at least one sample introduction device;

b. an inductively coupled plasma source;

c. at least one mass filter, d. at least one collision cell, and e. at least one mass analyzer;

wherein the at least one mass filter is arranged between the inductively coupled plasma source and the collision cell, and wherein the spectrometer further comprises at least one sample introduction system for delivering at least one reactive species into the inductively coupled plasma source, whereby the reactive species forms at least one molecular adduct ion with at least one ion generated from a sample in the inductively coupled plasma source, wherein the sample introduction system comprises at least one reactive gas inlet fluidly connected to the inductively couple plasma source and/or the sample introduction device and, wherein the sample contains a plurality of interfering isotopes having the same nominal mass and wherein a molecular adduct ion is formed in the plasma source from one of the interfering isotopes at a higher rate than from the other interfering isotope(s).

20. The mass spectrometer of claim 19, wherein the mass filter is configured to transmit ion species with a mass-to-charge ratio in a range that includes the mass-to-charge ratio of the molecular adduct ion that is formed in the inductively coupled plasma source but does not include the mass-to-charge ratio of product ions that are formed in the collision cell.

21. The mass spectrometer of claim 19, wherein the mass filter is configured to only transmit ion species with substantially the mass-to-charge ratios of the molecular adduct ions formed in the inductively coupled plasma source.

22. The mass spectrometer of claim 19, wherein the sample introduction device comprises a nebulizer or a laser ablation source.

23. The mass spectrometer of claim 19, further comprising a dual-function electrostatic lens, for selectively transmitting and reflecting ions, wherein the electrostatic lens is preferably arranged between the mass filter and the collision cell.

24. The mass spectrometer of claim 19, wherein the mass analyzer is a sector field analyzer, optionally comprising a multicollector for isotope ratio measurements.

25. The mass spectrometer of claim 19, further comprising at least one controller configured to operate the spectrometer such that the at least one molecular adduct ion formed in the inductively coupled plasma source is transmitted by the mass filter to the collision cell, whereby a product ion is formed in the collision cell from the at least one molecular adduct ion; wherein the product ion has a mass-to-charge ratio that is not transmitted by the mass filter; and wherein the product ion is mass analyzed in the mass analyzer.

26. The mass spectrometer of claim 25, wherein the product ion comprises a fragment ion of the at least one molecular adduct ion formed in the inductively coupled plasma source.

27. The mass spectrometer of claim 25, wherein the product ion comprises at least one further molecular adduct ion of the molecular adduction ion formed in the inductively coupled plasma source and a reactive gas that is introduced into the collision cell.

* * * * *